US010451384B2

(12) United States Patent
Conner et al.

(10) Patent No.: US 10,451,384 B2
(45) Date of Patent: Oct. 22, 2019

(54) COUPLED DUAL SWITCH ACTUATORS WITH LOCKOUT FEATURE FOR A LIGHTING ATTACHMENT TO A FIREARM

(71) Applicant: Bayco Products, Inc., Wylie, TX (US)

(72) Inventors: James Conner, Rockwall, TX (US); Aaron P. Shoulders, Sachse, TX (US)

(73) Assignee: Bayco Products, Inc., Wylie, TX (US)

( * ) Notice: Subject to any disclaimer, the term of this patent is extended or adjusted under 35 U.S.C. 154(b) by 171 days.

(21) Appl. No.: 15/459,466

(22) Filed: Mar. 15, 2017

(65) Prior Publication Data

US 2017/0268849 A1 Sep. 21, 2017

Related U.S. Application Data

(60) Provisional application No. 62/309,106, filed on Mar. 16, 2016.

(51) Int. Cl.
*F41G 1/35* (2006.01)
*F21V 3/04* (2018.01)
(Continued)

(52) U.S. Cl.
CPC ..... *F41G 1/35* (2013.01); *F21V 23/04* (2013.01); *F41A 35/06* (2013.01); *G05G 5/08* (2013.01);
(Continued)

(58) Field of Classification Search
CPC ... F41G 1/35; F41G 1/32; F41G 1/345; F41G 1/34; F41G 11/001; F41G 11/003;
(Continued)

(56) References Cited

U.S. PATENT DOCUMENTS 2,856,791 A * 10/1958 Matakas ..... G05G 1/08 188/70 R
4,373,405 A * 2/1983 Geil ..... G05G 1/08 188/67
4,539,860 A * 9/1985 Johnston ..... G05G 5/08 200/5 EA (Continued)

FOREIGN PATENT DOCUMENTS

CH 570028 A5 * 11/1975 ..... G06G 5/08
DE 102013008650 A1 * 11/2014 ..... H01H 9/24

OTHER PUBLICATIONS

EPO Translation of the Description of DE 102013008650 A1, Mami et al., Nov. 27, 2014. (Year: 2019).*

*Primary Examiner* — Daniel D Yabut
(74) *Attorney, Agent, or Firm* — Whitaker Chalk Swindle & Schwartz PLLC; Stephen Mosher

(57) ABSTRACT

An ambidextrous actuating mechanism configured as a mechanical interlock may be adapted to a battery operated light emitting device for mounting forward of the trigger guard of a firearm. The mechanism includes first and second mechanically coupled pivotable switch actuators disposed under and on either side of the barrel of the firearm. Operation of either one of the first and second actuator levers locks the other actuator from pivoting, thereby eliminating ambiguity and overridden operations in the control of the light emitting device. The operating motion of both actuators, either up for ON or down for MOMENTARY, is the same for both actuators. An alternate embodiment provides functionally equivalent electronically interlocked actuators.

19 Claims, 6 Drawing Sheets

(51) Int. Cl.

| | |
|---|---|
| ***F41A 35/06*** | (2006.01) |
| ***G05G 5/08*** | (2006.01) |
| ***F21V 23/04*** | (2006.01) |
| *F21V 33/00* | (2006.01) |
| *F21Y 115/10* | (2016.01) |

(52) U.S. Cl.
CPC ..... *F21V 33/008* (2013.01); *F21Y 2115/10* (2016.08)

(58) Field of Classification Search
CPC ..... F21V 23/0414; F21V 23/0421; F21V 23/0428; F21V 33/0076; F41A 35/06; G05G 1/087; G05G 1/10; G05G 1/12; G05G 1/08; G05G 5/08; H01H 19/14; H01H 19/18; H01H 19/183; H01H 19/20; H01H 19/28; H01H 21/06; H01H 2019/143; F16H 61/22; Y10T 74/20238
See application file for complete search history.

(56) References Cited

U.S. PATENT DOCUMENTS

| | | | | |
|---|---|---|---|---|
| 5,492,511 | A * | 2/1996 | Kozminski | G05G 1/04 477/22 |
| 7,117,624 | B2 * | 10/2006 | Kim | F41G 11/003 42/85 |
| 7,493,722 | B2 | 2/2009 | Howe et al. | |
| 8,499,482 | B1 * | 8/2013 | Di Trolio | F41A 17/42 42/70.01 |
| 2004/0154910 | A1 * | 8/2004 | Hayashi | G05G 1/08 200/412 |
| 2007/0253207 | A1 | 11/2007 | Coombs et al. | |
| 2008/0040965 | A1 | 2/2008 | Solinsky et al. | |
| 2014/0259846 | A1 * | 9/2014 | Joubert | F41A 17/56 42/70.11 |
| 2015/0276352 | A1 * | 10/2015 | Chang | F41G 11/003 42/114 |
| 2016/0306379 | A1 * | 10/2016 | Zils | G05G 5/02 |

* cited by examiner

FUNCTION CHART
PER MICROPROCESSOR SUBROUTINE

| MICROPROCESSOR STATES | | | LED FUNCTIONS |
|---|---|---|---|
| 1. GP1 AND GP8 | LO | (A1 = 0 AND A2 = 0) | LED = OFF (INITIAL CONDITION) |
| 2. GP2 | LO | (A1: CW TO 1) | LED CONSTANT ON |
| 3. GP0 | LO | (A1: CCW TO 1) | LED MOMENTARY ON UNTIL RELEASED |
| 4. GP3 | LO | (A1: PB1 PRESSED) | LED STROBED IF PRESSED 2X; MOMENTARY IF NOT PRESSED 2X. |
| 5. GP7 | LO | (A2: CCW TO 1) | LED CONSTANT ON |
| 6. GP9 | LO | (A2: CW TO 2) | LED MOMENTARY ON UNTIL RELEASED |
| 7. GP6 | LO | (A2: PB2 PRESSED) | LED STROBED IF PRESSED 2X; MOMENTARY IF NOT PRESSED 2X. |

NOTE: GP5 IS LO FOR STATE #1, HI FOR STATES 2, 3, 5, AND 6, AND PULSED FOR STATES 4 AND 7.

FIG. 4

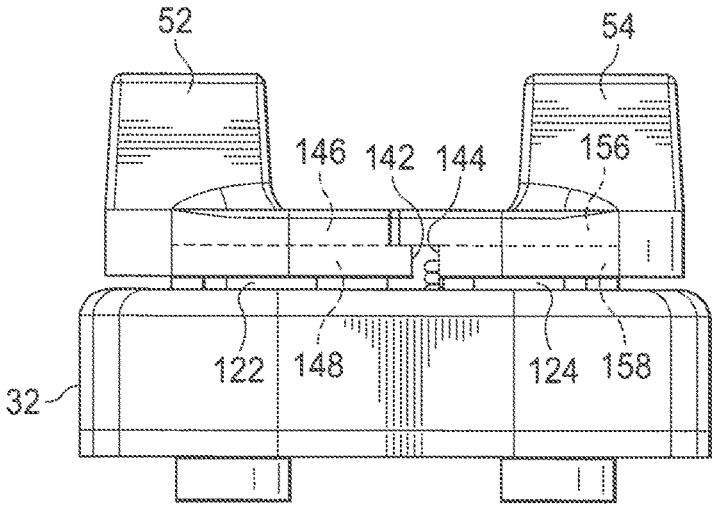

FIG. 10

COUPLED DUAL SWITCH ACTUATORS WITH LOCKOUT FEATURE FOR A LIGHTING ATTACHMENT TO A FIREARM

CROSS REFERENCE TO RELATED APPLICATIONS

The present application claims priority to U.S. Provisional Patent Application Ser. No. 62/309,106, filed Mar. 16, 2016, by the same inventors and with the same title.

BACKGROUND OF THE INVENTION

1. Field of the Invention

The present invention generally relates to battery operated illuminators or lighting devices mounted under the barrel of a firearm, and more particularly to providing ambidextrous, interlocked actuation of the lighting device from either side of the firearm.

2. Description of the Prior Art

Lighting devices used by public safety, security, and fire personnel are often mounted on hats, helmets, or on a firearm. An important feature on such devices that are typically not handheld, or in the case of firearms subject to right-hand or left-hand use, is that they be intuitively operable with either hand without risk of inadvertent (and possibly dangerous) or confusing operation because of ambiguous control modes. For example, a control having dual, sometimes independent modes is confusing to use because use of the two modes requires equal and opposite actions.

In the prior art there are several examples for the control of illumination devices by dual-acting actuators. In some so-called tactical illuminators, such as U.S. Pat. No. 7,117,624 issued to Kim the dual-acting actuator pivots around a single pivot so that operation of one end of the actuator (e.g., the right end) causes the opposite end to also operate, i.e., in a "see-saw" manner. However, to make use of the left end, the user must operate the left end in the opposite direction from the right end. This means the user must learn two opposite actions to accomplish the same thing, a potentially confusing circumstance. Thus, the actuators, though they provide two ways to activate the illumination device, do not operate independently and require two opposite modes of operation to utilize its dual capability.

In U.S. Pat. No. 7,493,722 issued to Howe et al. two separate and completely independent switch actuators are provided on either side of a firearm trigger guard to provide independent control of an illumination device. While it succeeds in providing fully independent control of the illumination device from either side of the firearm, or by either the right or left hand, it has the disadvantage that it is configured so that both switch actuators can be independently operated at the same time. Thus the opportunity for inadvertent operation leading to an unintended or indeterminate state of the illumination device is possible. For example, operating the left hand actuator downward and then releasing the actuator to provide a momentary operation of the device would be ineffective if the right hand actuator is in the upward position, overriding the user's intended operation of the momentary mode of the illumination device.

What is needed is a system of providing dual switch actuators operable by either hand or from either side that eliminates both of these disadvantages with unambiguous operating actions yet provides a degree of independence between the actuators.

SUMMARY OF THE INVENTION

Accordingly there is provided a switch actuator system having two separate switch actuators that are mechanically coupled together so that they can independently control an illumination device from either of the two actuators while locking out the other actuator from being inadvertently operated so that unambiguous activation of the illumination device always results.

In one embodiment an ambidextrous actuating mechanism for a tactical light is provided, comprising first and second control actuators pivotably mounted on a panel at respective first and second pivot centers disposed along a common centerline; wherein the control actuators are configured with a mutual interlock mechanism such that the pivoting of each first and second control actuator is limited by the mutual interlock mechanism so that only one of the control actuators may pivot about its pivot center at one time.

In one aspect, this embodiment provides that a clockwise (CW) or counterclockwise (CCW) pivot of either control actuator from a neutral position to an active position locks the other control actuator from pivoting from the neutral position, to ensure that only one control actuator can be in an active CW or CCW position at one time; and the return of a control actuator from an active CW or CCW position to the neutral position frees either control actuator to rotate to an active CW or CCW position.

In another aspect, the first control actuator comprises a primary level containing a first arcuate recess; and a secondary level adjacent and concentric with the primary level of the first control actuator and containing a circular perimeter of radius R of the first control actuator. The second control actuator comprises a primary level containing a second arcuate recess; and a secondary layer adjacent and concentric with the primary level of the second control actuator and containing a perimeter having a variable radius sufficient to clear the circular perimeter of radius R of the secondary level of the first control actuator as it pivots CW or CCW. In this embodiment the mutual interlock mechanism comprises a first and second interlocking configuration respectively formed in each first and second control actuator. Further, the first interlocking configuration comprises a first arcuate recess in a circular edge of the primary level of the first control actuator proximate the second control actuator; and the second interlocking configuration comprises a second arcuate recess in a circular edge of the primary level of the second control actuator bisected by a radial tenon member; wherein the radial tenon member extends into the first arcuate recess in the edge of the first control actuator and is aligned along the common centerline when the second control actuator is in a neutral position.

In another embodiment, an illuminator for use with a firearm having a trigger disposed below and aligned longitudinally with a barrel of the firearm is provided, comprising a housing including the illuminator and a battery, the housing mountable under the barrel and forward of and proximate the trigger of the firearm; and the first and second mechanically coupled, pivoting switch actuators are mounted at a respective pivot center disposed along a common transverse centerline on a rearward surface of the housing, one on either side of the plane of the trigger; wherein the first and second mechanically coupled, pivoting switch actuators are operable such that pivoting of either the first or the second pivoting switch actuator about its respective pivot center locks the other of the first or second pivoting switch actuators from pivoting.

In one aspect, the first pivoting switch actuator further comprises a first arcuate section removed from the disc portion thereof along a radius R centered at the pivot center of the second switch actuator at a distance D=1.5 R from the center of the first actuator along the common transverse centerline; and the second pivoting switch actuator comprises a second arcuate section removed from the disc portion of thereof along a radius R centered at the pivot center of the first switch actuator at a distance D=1.5 R from the pivot center of the second switch actuator along the common transverse centerline; and a tenon member disposed in the second arcuate section along the common transverse centerline and extending toward the center of the first actuator to a distance R from the center of the second switch actuator.

In a further aspect the first and second arcuate sections of the first and second pivoting switch actuators face each other to define a neutral OFF state in their respective unpivoted neutral positions along the common transverse centerline; and tenon member of the second pivoting switch actuator is disposed along the common transverse centerline into the first arcuate section of the first pivoting switch actuator; whereby pivoting of one of the first and second pivoting switch actuators about its respective pivot center locks the other pivoting switch actuator from pivoting until the one of the first and second pivoting switch actuators that was pivoted is returned to its unpivoted neutral position.

In yet another aspect, pivoting of either of the first and second pivoting switch actuators in an either upward or downward direction away from an unpivoted neutral position defines an ON state of the illuminator; pivoting of either of the first and second pivoting switch actuators in a downward direction away from the unpivoted neutral position defines a MOMENTARY ON state of the illuminator; and release of the switch actuator to the neutral position defines an OFF state of the illuminator.

BRIEF DESCRIPTION OF THE DRAWINGS

FIG. 4 illustrates a function chart relating the states of the microprocessor of FIG. 3 with the positions of the switch actuators and the functions of the light emitter;

FIG. 10 illustrates an edgewise (bottom, upward) view of the actuators depicted in FIGS. 5-9;

DETAILED DESCRIPTION OF THE INVENTION

The problem to be solved by the present invention can be stated as follows. Various actuator configurations are in use with tactical illumination devices. As described previously, the "see saw" design reverses the actuation function for left and right handed users, potentially ambiguous to a user. In another design, the use of independent left and right actuators allows for functions to be overridden, which can create a safety hazard under certain tactical situations.

In an advance in the state of the art, the solution presented herein provides two independently pivoting switch actuators that are coupled either mechanically or electrically so that operating one actuator to generate a function locks out the other actuator from generating a function of the tactical illuminating device. This solution provides the benefits of independent actuators (one for the left hand, one for the right hand) without the ambiguity of conventional designs. The mechanically coupled actuators employ pivoting actuators that are shaped to engage in a particular way when positioned close together. The electronically coupled option—an alternate embodiment—provides the interlock features in firmware resident in a microprocessor. It is described in FIGS. 3 and 4.

The ambidextrous actuating mechanism may be adapted to a battery operated light emitting device for mounting forward of the front of the trigger guard of a firearm. The mechanism includes first and second mechanically coupled pivoting switch actuators disposed under and on either side of the barrel of the firearm. Operation of either one of the first and second pivoting actuator levers locks the other actuator from rotation, thereby eliminating ambiguity and overridden operations in the control of the light emitting device. The operating motion of both actuators, either up for ON or down for MOMENTARY, is the same for both actuators.

In the following description, the actuators are described generally as being pivotable—that is, they are actuated by pivoting about an axis thus reflecting their lever-like function. However, since the actuators to be described are formed as extensions of round or disc-shaped members, they are also susceptible of being operable by "rotation" of the respective actuators. The resulting control action is the same whether described as "pivoting" or "rotating."

Figure 1:
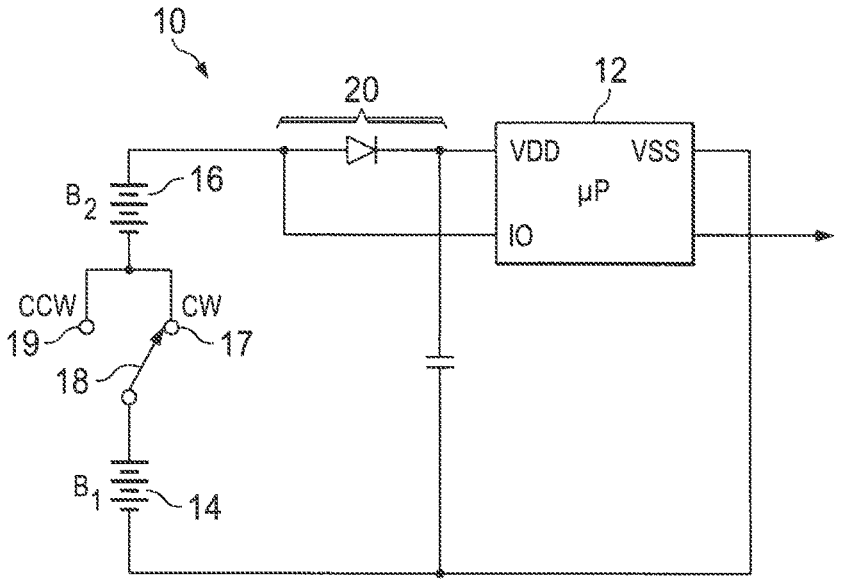
FIG. 1 illustrates a generalized circuit implementation according to the present invention.
Figure 2:
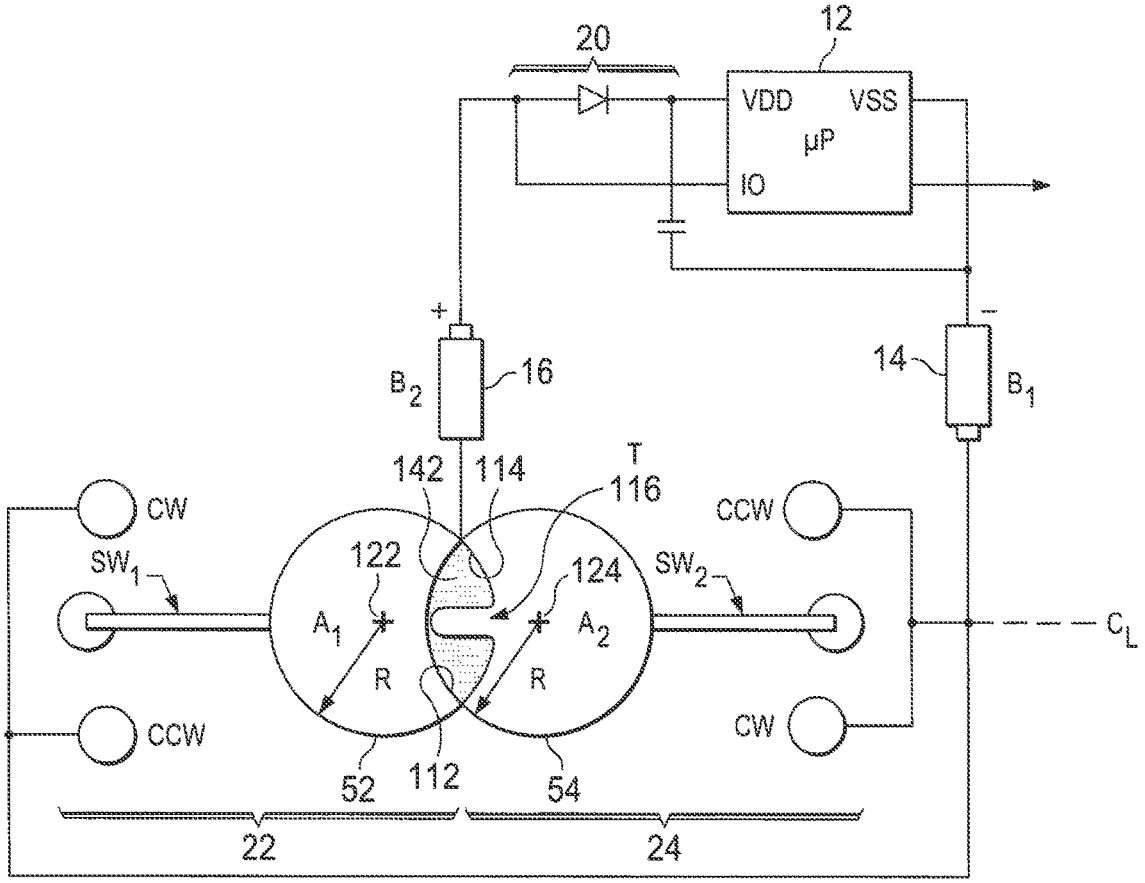
FIG. 2 illustrates the embodiment of FIG. 1 depicting details of the first and second switch actuators.

FIG. 1 depicts a generalized circuit diagram 10 for the concept embodied in the present invention. In the circuit 10 a microprocessor 12 receives its supply voltage via a blocking diode and capacitor circuit 20. The supply voltage shown as two batteries B1 (14) and B2 (16) in series with a single pole double throw (SPIT) switch 18 connected across the diode/capacitor combination 20 and the microprocessor 12. The switch 18 in FIG. 1 represents one half of the dual, mechanically coupled switch assembly to be described. In FIG. 1, the switch has three positions: neutral ("N") 15, "ON" CW (17), and "ON" CCW (19), where CW means clockwise and CCW means counterclockwise. In the illustrated design, the CW contact 17 is a latching contact corresponding to a full ON mode of the controlled circuit element (not shown in FIG. 1). The CCW contact 19 is a momentary contact corresponding to a momentary ON mode of the controlled circuit element (not shown in FIG. 1). FIG. 2 will expand on this concept in an illustration of a version of the invention wherein two separate switch mechanisms are used to provide ambidextrous operation of the switched device. The two separate switch mechanisms are mechanically interlocked so that only one of the switch actuators can be operated—i.e., pivoted either CW or CCW at one time.

Further, in FIG. 1, the capacitor provides a time delay by allowing the applied voltage to decay gradually when the switch 18 may be opened (in some applications) to facilitate a strobe function. For example, if the switch 18 is opened to the "N" or neutral position and rapidly closed to either "ON" position (CW or CCW) and opened again (before the supply voltage Vdd decays), the microprocessor 12 may interpret this action as an operation of the strobe mode.

Referring now to FIG. 2, a schematic, concept illustration of the dual, coupled pivoting switch actuators 52, 54 is shown. Also shown in FIG. 2 is the battery configuration from FIG. 1, wherein the battery B1 may be connected in series with battery B2 whenever either switch actuator 52 or 54 is pivoted to make a connection between the respective switch wiper $SW_1$ or $SW_2$ and one of its contacts CW or CCW.

Figure 9:
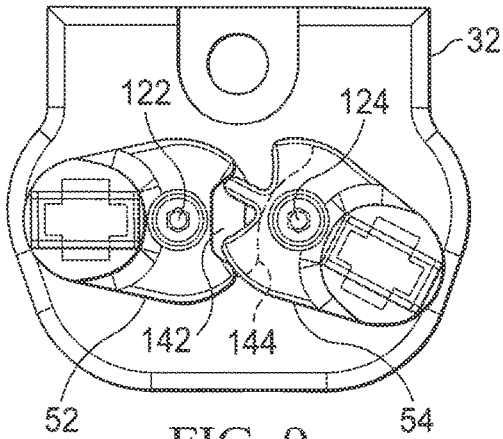
FIG. 9 illustrates an elevation view of the embodiment of FIG. 5 with the right side actuator in a clockwise position that locks the left side actuator in the neutral position, while enabling a momentary ON function of the light emitter.

The first 52 and second 54 pivoting actuators in FIG. 2 are shown in a neutral position wherein the contact wipers are shown oriented along a centerline $C_L$. Actuator 52 has an arcuate section 112 cut out of its perimeter. Actuator 54 also has an arcuate section 114 cut out except for a tenon member T (116) that is shown bisecting the arcuate section 114 and extending along the centerline CL into the mid-portion of the arcuate section 112. In a second, lower layer or level of actuator 52 is a full radius portion 130 of the pivoting actuator 52. In operation, as the second pivoting actuator 54 is pivoted or rotated clockwise (CW) toward the lower contact, the tenon member 116 moves CW within the arcuate portion 112 over the lower layer or level 130 of the first actuator 52. The pivoting or rotation causes the tenon member 116 to rotate through an angle of approximately 25 to 30 degrees before a stop that is formed into the second, lower layer or level portion of the second actuator 54 inhibits further rotation. This stop is not shown in FIG. 2, but appears in FIG. 10 as feature reference no. 144. When the stop 144 abuts against the second, lower level 130 of the first actuator 52, the tenon member 116 will appear as shown in FIG. 9. The action when the second actuator 54 pivots CCW is similar, with the pivoting inhibited by the stop 144 abutting against the first actuator 52 after pivoting about 25 to 30 degrees CCW. Further, the first actuator 52 may be pivoted through an angle of approximately 25 to 30 degrees either CW or CCW until is inhibited by the tenon member 116 of the second actuator, which is locked from rotation as soon as the first actuator 52 begins its pivot into the arcuate portion 114 of the second actuator 54, because the perimeter of the first actuator abuts against the arcuate portion 114 of the second actuator 54.

The method of mechanically coupling the switch actuators together includes configuring the first and second coupled, pivoting actuators A1 (52), A2 (54) as follows. As shown in the illustrative example of FIG. 2, the first and second pivoting actuators 52, 54 of radius R are mounted on a panel (not shown in this view) with their centers 122, 124 defining a centerline $C_L$ between them on the panel. In this illustration the centers 122, 124 of actuators 52 and 54 are separated along the centerline $C_L$ by a distance 1.5×R. The first actuator 52 is configured by removing an arcuate section along a radius R centered a distance D=1.5 R from the center 122 of the first actuator 52 along the centerline $C_L$. The second actuator 54 is configured by removing an arcuate section along a radius R centered a distance D=1.5 R from the center 124 of the second actuator 54 along the centerline $C_L$ except for a tenon member T (116) disposed along the centerline $C_L$ and extending toward the center 122 of the first actuator 52 to a distance R from the center 124 of the second actuator 54. Note how the removed arcuate portions of the actuators 52 and 54 resemble a rounded bite taken out of the edges of the actuators, as shown in FIGS. 2 and 5 through 9. It should also be noted that the values of R and D are approximations for a typical example to illustrate the concept employed in the present invention for providing the mechanical interlock of the first and second switch actuators. Some applications may adjust these values as needed.

The centers 122, 124 of the first and second pivoting actuators 52, 54 are mounted on the panel 32 (see FIGS. 5-11) along the centerline $C_L$ with their centers 122, 124 spaced D=1.5 R apart in this example such that the arcuate sections are facing each other, thus defining an un-pivoted (i.e., neutral) position (FIG. 5) for each actuator 52, 54. The tenon member T 116 of the second actuator 54 extends along the centerline $C_L$ into the arcuate section of the first actuator 52. Thus, pivoting of one of the first and second actuators 52, 54 about its respective center 122, 124 locks the other actuator from pivoting until the one of the first and second actuators 52, 54 that was pivoted is returned to its un-pivoted or neutral position. This structure is shown in FIGS. 5 through 9 and FIG. 11.

Figure 3:
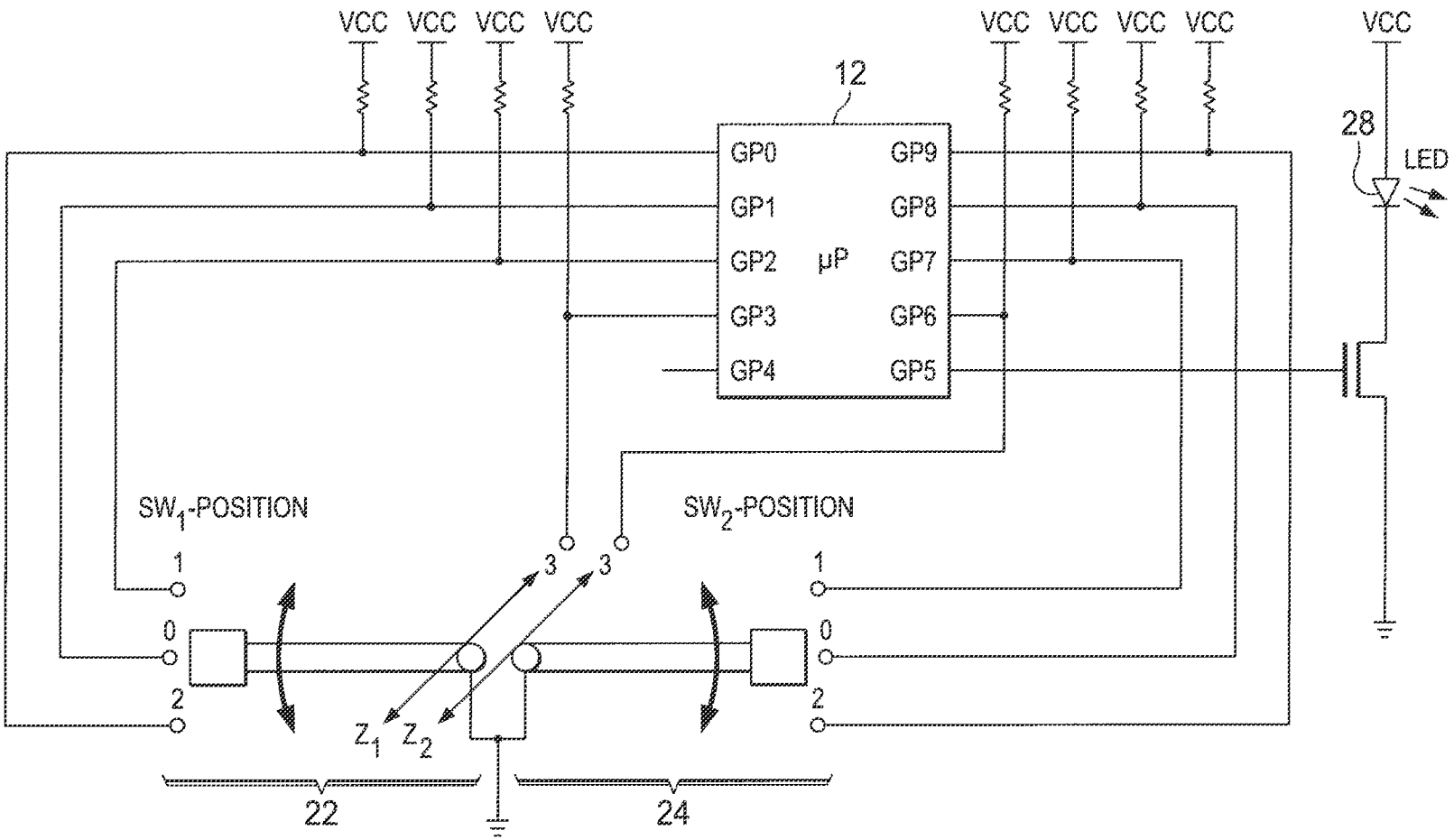
FIG. 3 illustrates a circuit diagram of the switch actuators of the illustrated embodiment as connected to the inputs of a microprocessor that drives the light emitter under the control of firmware.

The electronically coupled method, depicted in FIG. 3 schematically and in FIG. 4 as an operational function chart, may employ firmware in a microprocessor to control the function generated when one of the actuators is pivoted. In this embodiment, the first and second actuators A1 (22), A2 (24) do not need to be mechanically interlocked; rather, the pivot or position of both actuators 22, 24 may be sensed, for example by the microprocessor while monitoring the state of each of its terminals or pins that are connected to the switch contacts, and the resulting signals used in a logical sequence to electrically "lock out" the ability of the actuator that is not operated by the user, i.e., the locked out actuator, to control the operation of the controlled device. FIG. 3 illustrates the circuits of switch actuators 22 and 24 in a circuit that pulls down the supply voltage Vcc applied to the GP terminals of the microprocessor 12. The pull down action applies a ground (logic 0 or "LO") connection to effect specific operating modes of the LED 28. These modes are listed in the FUNCTION CHART of FIG. 4.

FIG. 4 lists one embodiment of a function chart to illustrate the outcomes of the operations performed by the subroutines stored in the microprocessor. These functions consist of eight modes according to which GP pin of the microprocessor is pulled LO (logic 0). For example, in the first mode listed, No. 1, pins GP1 and GP 8 are pulled LO (corresponding to actuator A1=0 and actuator A2=0), to set the controlled LED 28 to OFF, its initial condition. Similarly, in mode No. 2, the pin GP2 is pulled LO corresponding to actuator A1 having pivoted CW to the "1" position to set the controlled LED 28 to a constant ON condition. The remaining modes operate in a similar manner as defined in FIG. 4. Note in FIG. 4 that the input pin GPS of the microprocessor is LO for state #1, HI for states number 2, 3, 5, and 6, and pulsed for states number 4 and 7 to provide the strobe mode if it is included in the subroutine of a particular model of the product that embodies the invention. The strobe mode as depicted in FIG. 4 may be an alternate embodiment that will also be described in FIG. 11. Note also in FIG. 4 that microprocessor states responsive to pins GP3 and GP6 represent alternate modes available when a push button switch actuator is disposed along the center of rotation or Z-axis of each first and second actuator A1 and A2. These modes can be used to provide additional operating features such as the strobe modes shown in FIG. 4.

Turning now to FIGS. 5-9, the positions of the actuators in the various operating modes of the mechanical embodiment of FIG. 2 are depicted in FIGS. 5 through 9. The actuators 52 and 54 are mounted on panel 32 so that they rotate or pivot about an axis 122, 124 respectively disposed in the center portion of each actuator 52, 54. It should be noted that when one actuator is pivoted, the structure of the actuator discs is configured to lock the other actuator from also pivoting at the same time as described herein above.

Figure 5:
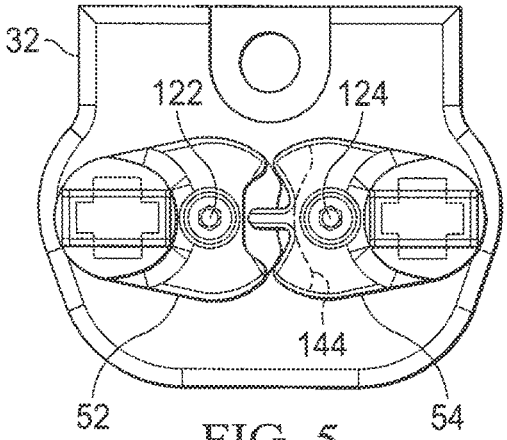
FIG. 5 illustrates an elevation view of the mechanically coupled switch actuators when in a neutral position corresponding to the OFF function of the light emitter.
Figure 12:
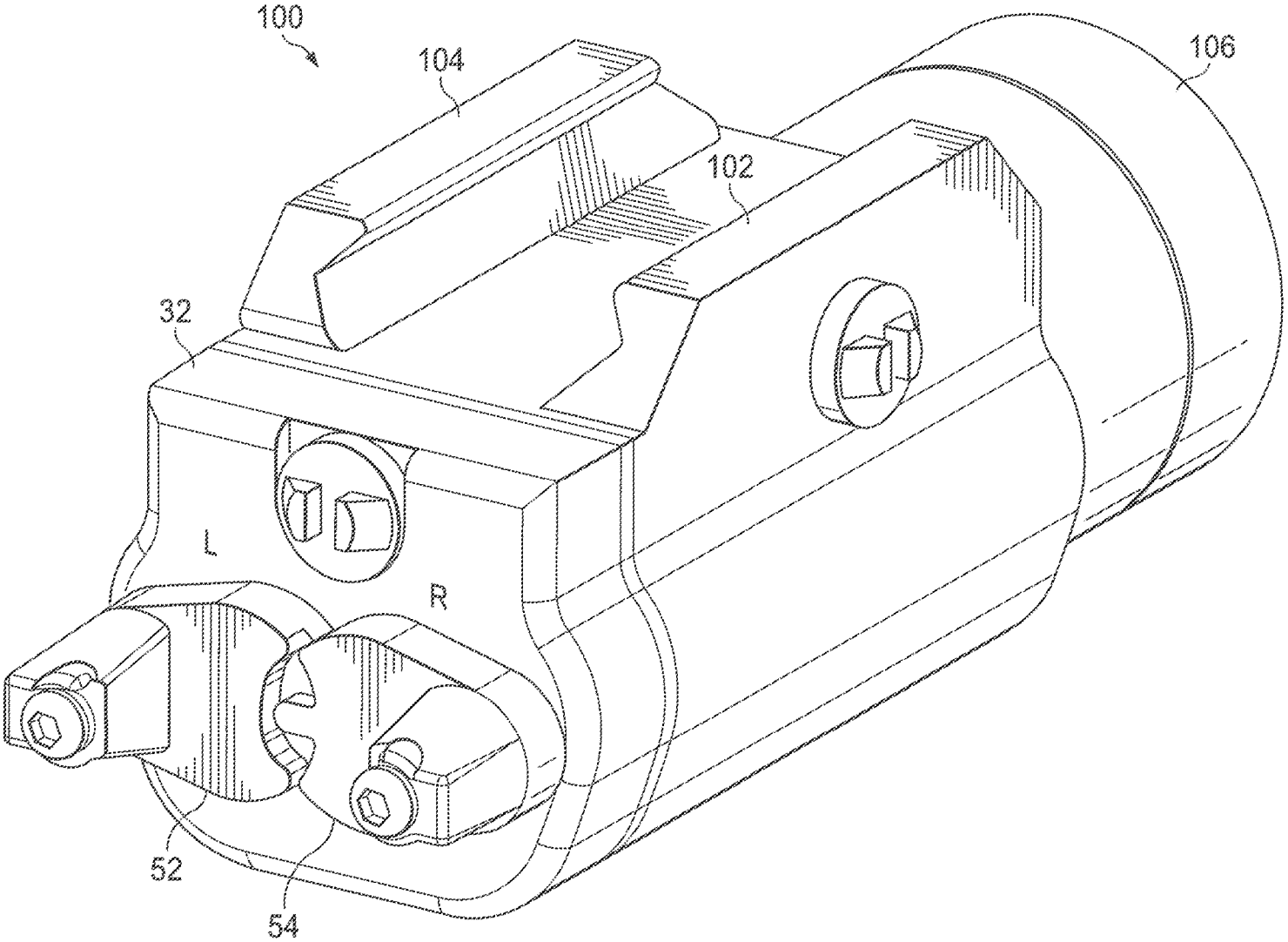
FIG. 12 illustrates a perspective view of a tactical illuminating device that embodies the present invention.

In FIG. 5, the actuators 52 and 54, mounted on the panel 32 at the respective pivot axes 122, 124, are shown in the neutral position corresponding to the OFF condition of the controlled circuit, an LED light source as in the typical application shown in FIG. 12. This configuration of the actuators is similar to the configuration depicted in FIG. 2. Further, this orientation of the panel 32 and its actuators 52, 54 is the view as seen by the user of a firearm to which an LED tactical light unit is attached just below the barrel of the firearm and just in front of the trigger guard where the user's trigger finger can reach the actuators. The two actuators, one on the left (52) and one on the right (54 in this embodiment are positioned so that the actuating system is useable by right or left handed users.

Figure 6:
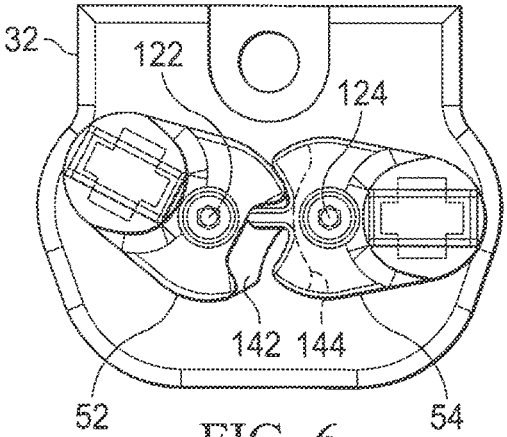
FIG. 6 illustrates an elevation view of the embodiment of FIG. 5 with the left side actuator in a clockwise position that locks the right side actuator in the neutral position while enabling a constant ON function of the light emitter.
Figure 8:
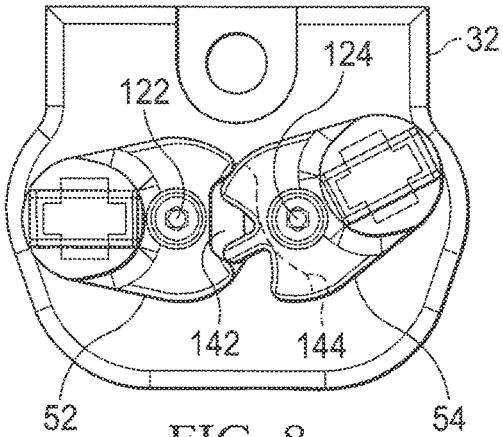
FIG. 8 illustrates an elevation view of the embodiment of FIG. 5 with the right side actuator in a counterclockwise position that locks the left side actuator in the neutral position, while enabling a constant ON function of the light emitter.
Figure 7:
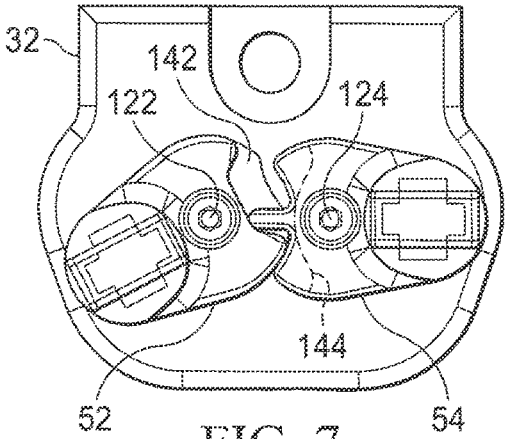
FIG. 7 illustrates an elevation view of the embodiment of FIG. 5 with the left side actuator in a counterclockwise position that locks the right side actuator in the neutral position while enabling a momentary ON function of the light emitter.

FIGS. 6 through 9 respectively depict the same actuator panel 32 with the actuators 52, 54 positioned as follows: FIG. 6: actuator 52 in the CW position to turn ON the LED source while locking the actuator 54 in the neutral position. FIG. 7: actuator 52 in the CCW position to momentarily turn ON the LED source while locking the actuator 54 in the neutral position until the actuator 52 is released so that it may be returned to the neutral position by a spring (not shown). FIG. 8: actuator 54 in the CCW position to turn ON the LED source while locking the actuator 52 in the neutral position. FIG. 9: actuator 54 in the CW position to momentarily turn ON the LED source while locking the actuator 52 in the neutral position until the actuator 54 is released so that it may be returned to the neutral position by a spring (not shown). When either actuator 52, 54 is pivoted to the "upward" position, CW for actuator 52 or CCW for actuator 54, the LED source is latched ON—that is, it remains ON until the actuator is pivoted back to its neutral position. When either actuator 52, 54 is pivoted to the "downward" position, CCW for actuator 52 or CW for actuator 54, the LED source is ON only has long as the respective actuator is held "downward," to effect the MOMENTARY control function.

FIG. 10 illustrates an edgewise (bottom, upward) view of the first and second actuators 52, 54 depicted in FIGS. 5-9. In this view the arcuate portions of the actuators are seen to have two distinct profiles on adjacent levels. In the figure, the "upper" or primary level is actually the front face of the actuator assembly (as seen from the user's point of view) and the "lower" or secondary level is actually the back side (i.e., adjacent to the panel 32) of each actuator. In the first (left side) actuator 52 the arcuate portion 112 occupies the primary level 146, and the outer perimeter 142 of the secondary level 148 extends to the full radius R past the arcuate portion 112. Thus, a ledge or relief is provided by the secondary level 148 in the first actuator 52 for the motion of the tenon member T 116 portion of the second actuator 54 when either actuator 52, or 54 is rotated from its neutral position along the centerline $C_L$. The primary level 156 of the second actuator 54 contains its arcuate portion 114 with the tenon member T 116 extending radially, bisecting the arcuate portion 114. The secondary level 144 of the second actuator 54 includes a relieved region a compound arcuate portion (a wavy line corresponding to a variable radius R in that portion of the second actuator 54) roughly similar to the arcuate portion 112 of the primary level 146 of the first actuator, to allow the pivoting of the first actuator 52 under the tenon member T 116. One advantage of the bi-level design into primary 146, 156 and secondary 148, 158 levels is to stabilize the rotation of the actuators 52, 54.

Figure 11:
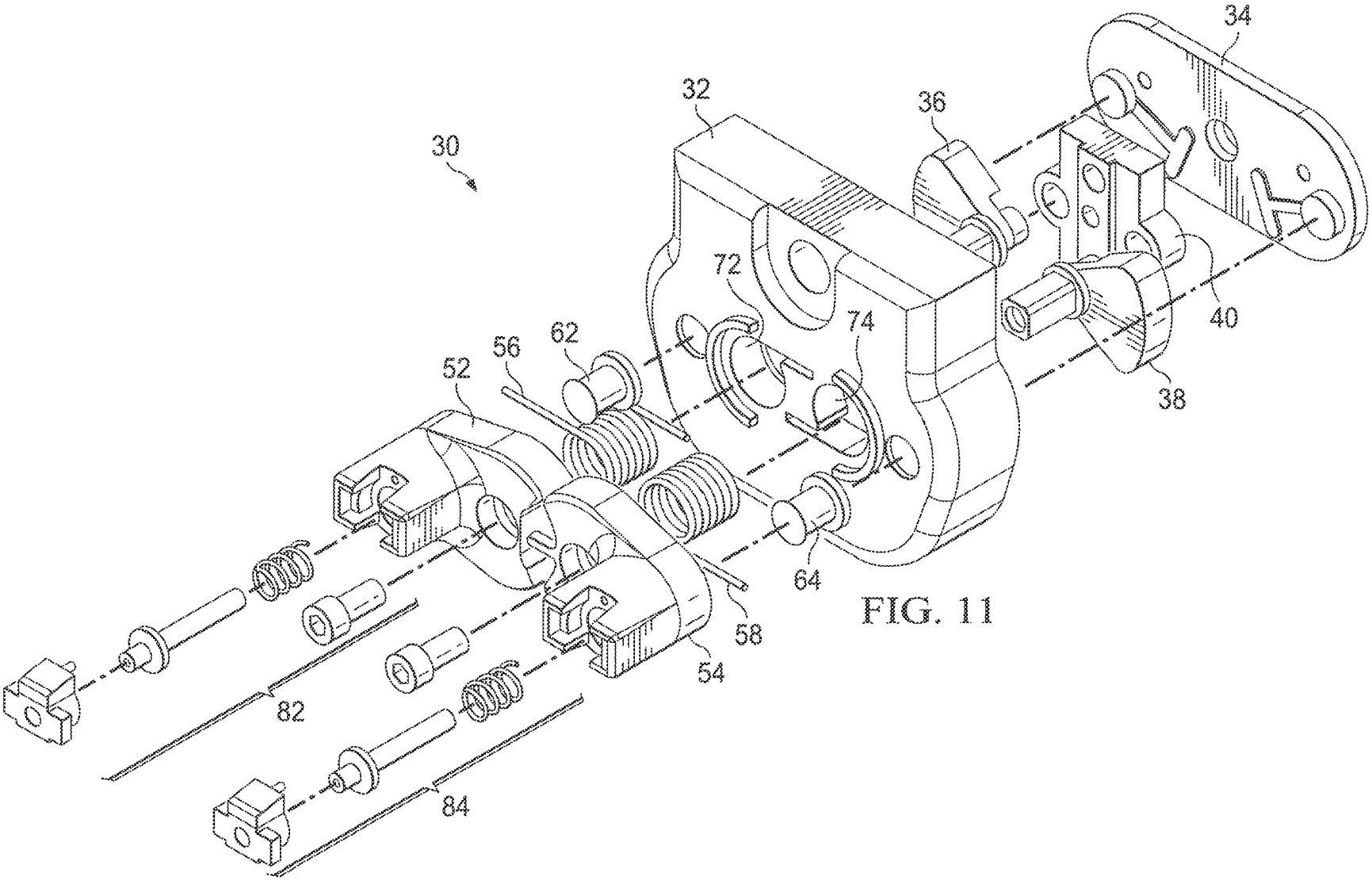
FIG. 11 illustrates an exploded perspective view of an actuator assembly according to the present invention depicting the mechanical structure.

FIG. 11 illustrates an exploded view of the switch actuator assembly 30, which shows the main embodiment described in detail herein and an alternate embodiment. The main embodiment comprises the first and second actuators 52, 54 as mounted on the panel 32. The alternate embodiment adds Z-axis push-button switch actuators 82, 84 to the first 52 and second 54 actuators to expand the utility of the mechanical actuator system. The z-axis mechanisms 82, 84 act through switch covers 62, 64 through the panel 32 to connect to corresponding switch contacts (not shown) located behind the panel 32 on PC board 34. The main embodiment includes the actuators 52, 54, the panel 32, the return torsion springs 56, 58 and a pivot axis disposed through first 72 and second 74 holes in the panel 32 along with the respective pivoting arms 36, 38, which may be retained by a keeper 40. The pivoting arms 36, 38 are coupled through the holes 72, 74 and the return torsion springs 56, 58 to the pivot centers 122, 124 of the first 52 and second 54 actuators.

FIG. 12 illustrates one example of a tactical light 100 with which the ambidextrous actuator assembly 30 described herein may be used. The tactical illumination device—here a light source—includes a front lens assembly 106 through which the emitted light emerges, and first 102 and second 104 mounting rails. The mounting rails 102, 104 may be formed as a pair of rails, one of which is movable like a jaw of a vise that may be used to secure the tactical illumination device to a similar rail structure on the underside of a firearm. As depicted on the panel 32, the left (first) actuator 52 is shown engaged with the right (second) actuator 54. Each actuator 52, 54 may also have a push button "Z-axis" switch mechanism 82, 84 disposed in a lever extension of the left 52 and right 54 actuators. In that embodiment, operable when the first and second actuators 52, 54 are in the neutral position, the push button actuators 82, 84 when pressed and released twice in rapid succession, for example, (before the supply voltage Vcc decays), may be used to enable operation of a strobe mode of the LED by either left or right actuator 52, 54 as described in the Function Chart of FIG. 4. The push button actuators 82, 84 may preferably operate along a "Z" axis that is parallel with the longitudinal axis of the tactical illumination device that extends through the center of the tactical illumination device (not shown).

While the invention has been shown in only one of its forms, it is not thus limited but is susceptible to various changes and modifications without departing from the spirit thereof.

What is claimed is:

1. An illuminator for use with a firearm having a trigger disposed below and aligned longitudinally with a barrel of the firearm, comprising:

a housing including the illuminator and a battery, the housing mountable under the barrel and forward of and proximate the trigger of the firearm; and a first and a second mechanically coupled, pivoting switch actuator are each mounted at a respective pivot center disposed along a common transverse centerline on a rearward surface of the housing, one on either side of the plane of the trigger; wherein the first and second mechanically coupled, pivoting switch actuators are operable such that pivoting of either the first or the second pivoting switch actuator about its respective pivot center locks the other of the first or second pivoting switch actuators from pivoting.

2. The illuminator of claim 1, wherein each first and second pivoting switch actuator comprises:

a disc portion having a radius R and a lever portion extending from the edge of each disc portion in a direction opposite the other switch actuator; and the pivot centers of the disc portions of the first and second switch actuators are spaced D=1.5 R apart.

3. The illuminator of claim 2, wherein the first pivoting switch actuator further comprises:

a first arcuate section removed from the disc portion thereof along a radius R centered at the pivot center of the second switch actuator at a distance D=1.5 R from the center of the first actuator along the common transverse centerline.

4. The illuminator of claim 2, wherein the second pivoting switch actuator comprises:

a second arcuate section removed from the disc portion of thereof along a radius R centered at the pivot center of the first switch actuator at a distance D=1.5 R from the pivot center of the second switch actuator along the common transverse centerline; and a tenon member disposed in the second arcuate section along the common transverse centerline and extending toward the center of the first actuator to a distance R from the center of the second switch actuator.

5. The illuminator of claim 1, wherein:

a first and a second arcuate section of each first and second pivoting switch actuator face each other to define a neutral OFF state in their respective unpivoted neutral positions along the common transverse centerline; and the tenon member of the second pivoting switch actuator is disposed along the common transverse centerline into the first arcuate section of the first pivoting switch actuator.

6. The illuminator of claim 1, wherein:

pivoting of one of the first and second pivoting switch actuators about its respective pivot center locks the other pivoting switch actuator from pivoting until the one of the first and second pivoting switch actuators that was pivoted is returned to its unpivoted neutral position.

7. The illuminator of claim 1, wherein:

pivoting of either of the first and second pivoting switch actuators in an either upward or downward direction away from an unpivoted neutral position defines an ON state of the illuminator.

8. The illuminator of claim 1, wherein:

pivoting of either of the first and second pivoting switch actuators in a downward direction away from the unpivoted neutral position defines a MOMENTARY ON state of the illuminator; and release of the switch actuator to the neutral position defines an OFF state of the illuminator.

9. The illuminator of claim 1, wherein:

the housing includes at least one light source operated by the battery and controlled by the first and second pivoting switch actuators to provide connections between the battery and the at least one light source.

10. The illuminator of claim 1, further comprising:

a first pivoting switch actuator pivotably coupled to the housing and operable from a first side of the trigger; and a second pivoting switch actuator pivotably coupled to the housing and operable from a second side of the trigger; wherein the first and second pivoting switch actuators pivot independently about separate parallel axes.

11. The apparatus of claim 1, wherein:

the first and second switch actuators include a Z-axis push button operable along the respective pivot axes of the first or second control actuators to provide an additional control function.

12. An ambidextrous electronic actuating mechanism for a tactical light, comprising:

first and second control actuators pivotably mounted on a panel at respective first and second pivot centers disposed along a common centerline; wherein the first and second control actuators are coupled with a mutual electronic interlock wherein the pivoting of each first and second control actuator is detected by the mutual electronic interlock such that the function of only one of the control actuators is operational at one time as it pivots about its respective pivot center.

13. The apparatus of claim 12, wherein:

a clockwise (CW) or counterclockwise (CCW) pivot of either first or second control actuator from a neutral position to an active position inhibits the function of the other control actuator to ensure that only one control actuator can be in an active CW or CCW position at one time; and the return of a control actuator from an active CW or CCW position to the neutral position frees either control actuator to be pivoted to an active CW or CCW position.

14. The apparatus of claim 13, wherein the neutral position comprises:

an inactive condition of either the first or second control actuator when aligned along the common centerline.

15. The apparatus of claim 12, wherein the first control actuator comprises:

a lever oriented laterally along the common centerline leftward from the pivot center and operable upward when active CW and operable downward when active CCW.

16. The apparatus of claim 12, wherein the second control actuator comprises:

a lever oriented laterally along the common centerline rightward from the pivot center and operable upward when active CCW and operable downward when active CW.

17. The apparatus of claim 12, wherein the mutual electronic interlock comprises:

a first and second interlocking subroutine programmed into a microprocessor coupled to and respectively responsive to each first and second control actuator.

18. The apparatus of claim 17, wherein:

the first and second control actuators include a Z-axis push button operable along the respective pivot axes of the first or second control actuators to provide an additional control function.

19. The apparatus of claim 12, wherein:

a pivot angle of the first and second control actuators is limited to a predetermined angle relative to the common centerline; and the common centerline is disposed laterally.

* * * * *